US006623289B2

(12) United States Patent
Decicco

(10) Patent No.: US 6,623,289 B2
(45) Date of Patent: Sep. 23, 2003

(54) EXPLOSION-PROOF INSTRUMENT QUICK DISCONNECT AND SEAL

(75) Inventor: Pascal Decicco, Islin, NJ (US)

(73) Assignee: Manny Silverio, Hackensack, NJ (US)

( * ) Notice: Subject to any disclaimer, the term of this patent is extended or adjusted under 35 U.S.C. 154(b) by 0 days.

(21) Appl. No.: 09/924,076

(22) Filed: Aug. 7, 2001

(65) Prior Publication Data

US 2002/0192993 A1 Dec. 19, 2002

Related U.S. Application Data

(60) Provisional application No. 60/298,300, filed on Jun. 14, 2001.

(51) Int. Cl.[7] ..... H01R 13/52
(52) U.S. Cl. ..... 439/271
(58) Field of Search ..... 439/271, 277, 439/320, 589

(56) References Cited

U.S. PATENT DOCUMENTS

| | | | | | |
|---|---|---|---|---|---|
| 2,700,140 | A | * | 1/1955 | Phillips | 439/274 |
| 3,040,287 | A | * | 6/1962 | Agron et al. | 439/275 |
| 3,172,721 | A | * | 3/1965 | Kelly | 439/589 |
| 3,643,207 | A | | 2/1972 | Cairns | |
| 4,758,174 | A | * | 7/1988 | Michaels et al. | 439/281 |
| 4,801,277 | A | * | 1/1989 | Seilhan | 439/680 |
| 4,857,006 | A | * | 8/1989 | Linyeav et al. | 439/271 |
| 5,194,012 | A | * | 3/1993 | Cairns | 439/271 |

FOREIGN PATENT DOCUMENTS

| | | |
|---|---|---|
| GB | 2 152 302 A | 7/1985 |
| GB | 2 355 348 A | 4/2001 |
| WO | WO 97/03483 | 1/1997 |

OTHER PUBLICATIONS

Contact Electronics, Inc. OnLine Catalog (www.contactelectronics.com), pp. 415–422 (Circon R2.5 Series Circular Connectors).
Appleton Electric Company Master Catalog 005 (Revision 2), pp. 16–17 and pp. L1–L4.
Cooper Crouse–Hinds Products Catalog 2000 Edition, p. 8F–0 (Condulet Seals Breathers and Drains).
Turck Works Cordsets Catalog B0410, Jun. 1999, pp. A1–G33 (entire catalog).
Brad Harrison mPm Designer's Guide, Jun. 2000, pp. 1–364 (entire catalog).
MTL Instruments Group Publication entitled "MTL951 Hazardous Area Connectors", Sep. 2002.

* cited by examiner

*Primary Examiner*—Lynn D. Feild
*Assistant Examiner*—Brian S. Webb
(74) *Attorney, Agent, or Firm*—Morgan & Finnegan, LLP

(57) ABSTRACT

An explosion-proof instrument quick disconnect and seal is provided for use in hazardous (e.g., explosive) environments to quickly connect or disconnect energized or de-energized electrical circuits. The quick disconnect and seal includes mating electrical receptacle inserts positioned within a male and a female portion. The male and female portions are connected to one another by a coupling nut having threads that engage mating threads on the male portion, thereby moving the male portion relative the female portion by rotation of the coupling nut, while at the same time preventing the electrical connection of the mating receptacle inserts in the male and female portions before the explosion-proof chamber is secure.

25 Claims, 3 Drawing Sheets

EXPLOSION-PROOF INSTRUMENT QUICK DISCONNECT AND SEAL

CROSS-REFERENCE TO RELATED APPLICATION

This application claims the benefit of U.S. Provisional Application No. 60/298,300, filed Jun. 14, 2001.

BACKGROUND OF THE INVENTION

1. Field of the Invention

The present invention relates to quick connectors/disconnectors for electrical circuits, and more particularly, to an explosion-proof instrument quick disconnect and seal for use in hazardous environments to quickly connect or disconnect electrical circuits.

2. Description of the Related Art

There are many applications today where electrical connections are made in hazardous (e.g., explosive) environments, such as locations where ignitable concentrations of flammable gases, vapors or liquids are present or may become present through accident or abnormal operation. For instance, Article 500 of the National Electrical Code ("NEC") has classified certain locations as hazardous, including Class I (combustible material in the form of gas vapors) and Class II (combustible material in the form of dust).

In most modem industrial applications, electrical wiring/cable passes through a conduit system from location to location, such as from an enclosure housing of an electronic instrument to terminals in junction boxes outside the instrument or to the plant electrical and instrumentation distribution systems. Electrical circuits present certain inherent risks in hazardous environments because electrical sparks or arcing may occur when an electrical circuit is made or disconnect using a plug and receptacle due to the sudden flow or interruption of electrical energy. For this reason, NEC requires that conduit connections in certain hazardous environments be sealed with an approved explosion-proof seal fitting to prevent hazardous gases from traveling through the conduit system in the event of an internal explosion and to prevent a flame or an internal explosion from igniting the surrounding atmosphere.

In such hazardous environments, it is known to install explosion-proof seal fittings at various locations along the conduit system to prevent the passage of gases, vapors or flames from one portion of the electrical installation to another through the conduit. These conventional seal fittings typically have an opening through which a sealing compound or cement is introduced to literally seal the conduit and wire/cable contained therein at that location. However, these seal fittings are expensive and their installation is labor intensive. Furthermore, removal of the seal (e.g., for maintenance or service of the electrical system) is exceedingly difficult and typically requires either cutting the seal fitting off of the conduit system (which may also result in cutting the wire/cable contained therein) or chipping away the sealing compound contained within the fitting.

Accordingly, it is desirable to have a device for quickly connecting or disconnecting live electrical circuits in indoor and outdoor hazardous areas that includes an explosion-proof seal for preventing hazardous gases, vapors or liquids from traveling through the conduit system in the event of an internal explosion and to prevent a flame or internal explosion from igniting the surrounding atmosphere.

SUMMARY OF THE INVENTION

These and other objects of the present invention are accomplished through the use of an explosion-proof instrument quick disconnect to be used in hazardous (e.g., explosive) environments to quickly connect or disconnect energized or de-energized electrical circuits. The device also acts as an explosion-proof conduit seal in which a sealing compound is poured through the ends where wire/cable exits the connector, therefore meeting the requirements of the NEC and eliminating the need for separate seal fittings surrounding the device.

The explosion-proof instrument quick disconnect and seal comprises a first portion having a first bore extending therethrough from a proximal end to a distal end. A second portion is detachably coupled to the first portion and has a second bore extending therethrough from a first end to a second end. The second end of the second portion is received within the first bore of the first portion to define an explosion-proof chamber within the first and second portions when the first and second portions are coupled to one another. First and second electrical inserts, each having electrical contacts, are positioned within the first bore of the first portion and second bore of the second portion, respectively. Each of the electrical contacts in the first electrical insert engage and form an electrical connection with a respective electrical contact in the second electrical insert within the explosion-proof chamber when the first and second portions are coupled to one another.

The foregoing specific objects and advantages of the invention are illustrative of those that can be achieved by the present invention and are not intended to be exhaustive or limiting of the possible advantages which can be realized. Thus, these and other objects and advantages of this invention will be apparent from the description herein or can be learned from practicing this invention, both as embodied herein or as modified in view of any variations which may be apparent to those skilled in the art. Accordingly, the present invention resides in the novel parts, constructions, arrangements, combinations and improvements herein shown and described.

BRIEF DESCRIPTION OF DRAWINGS

The foregoing features and other aspects of the invention are explained in the following description taken in connection with the accompanying drawings wherein.

DETAILED DESCRIPTION

In accordance with the present invention, an explosion-proof instrument quick disconnect and seal is provided for use in hazardous (e.g., explosive) environments to quickly connect or disconnect energized or de-energized electrical circuits. A preferred embodiment of the present invention is described below with reference to the drawings.

Figure 1:
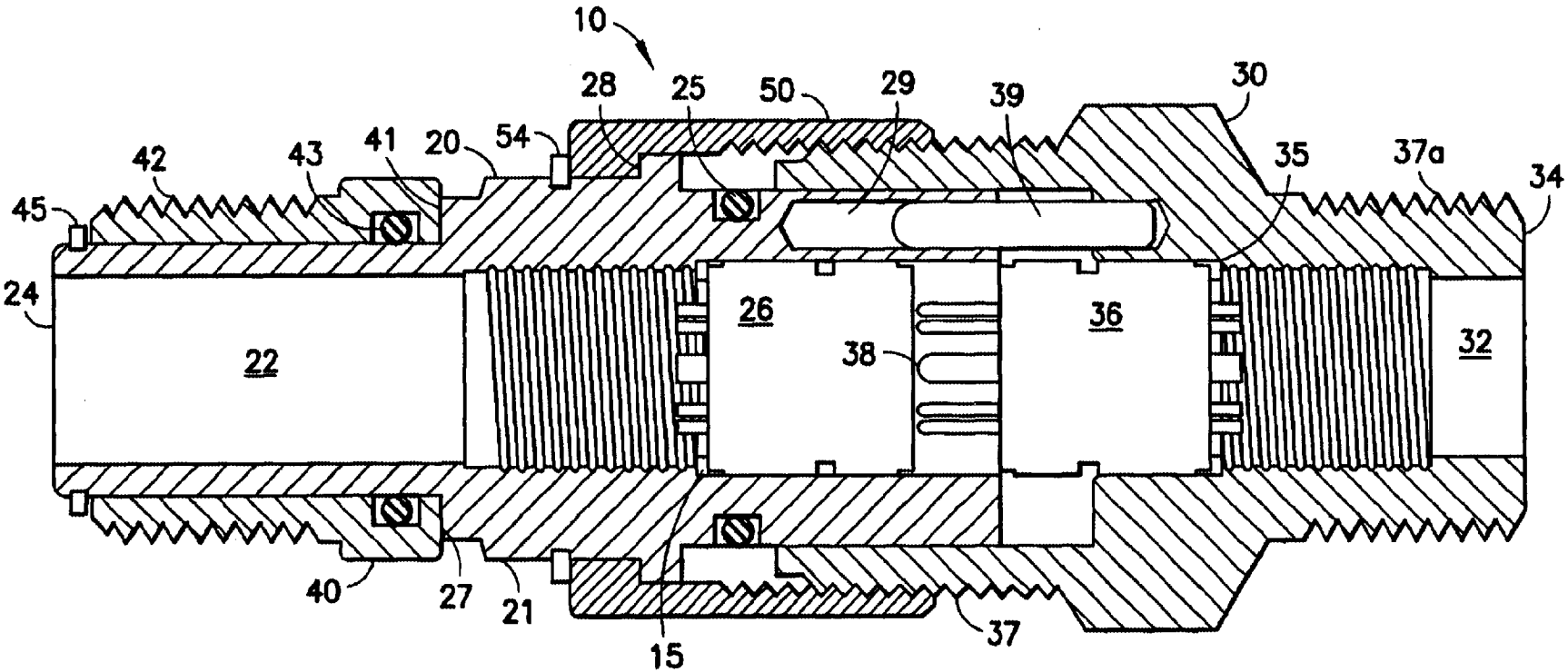
FIG. 1 is a cross-sectional view of a partially assembled explosion-proof quick disconnect and seal in accordance with a preferred embodiment of the present invention.

Referring to FIG. 1, there is shown an assembled explosion-proof instrument quick disconnect and seal 10 in accordance with a preferred embodiment of the present invention. The quick disconnect and seal 10 includes two mating portions, a female portion 20 and a male portion 30, which, as discussed below, are designed to be readily coupled to and, alternatively, separated from one another.

Figure 2:
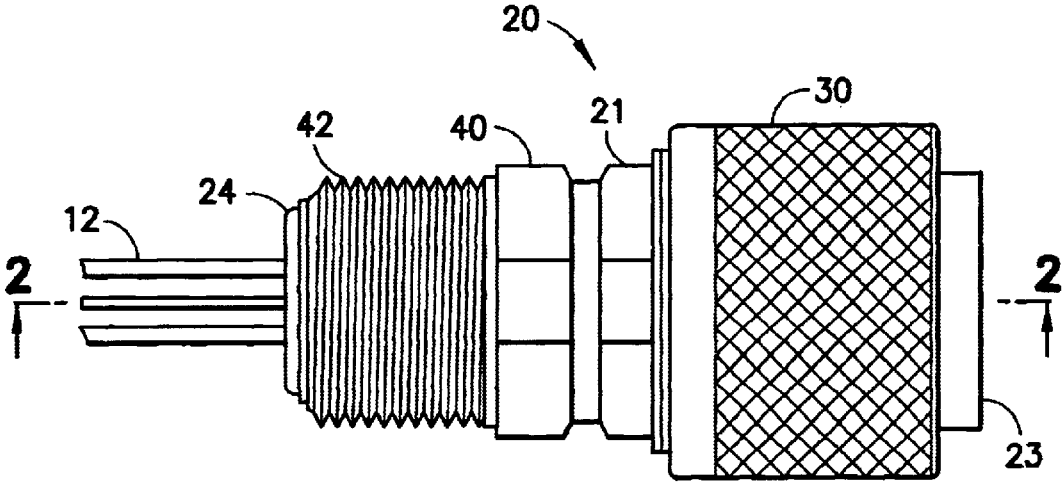
FIG. 2 is a side elevational view of the female end of the explosion-proof quick disconnect and seal illustrated in FIG. 1.
Figure 3:
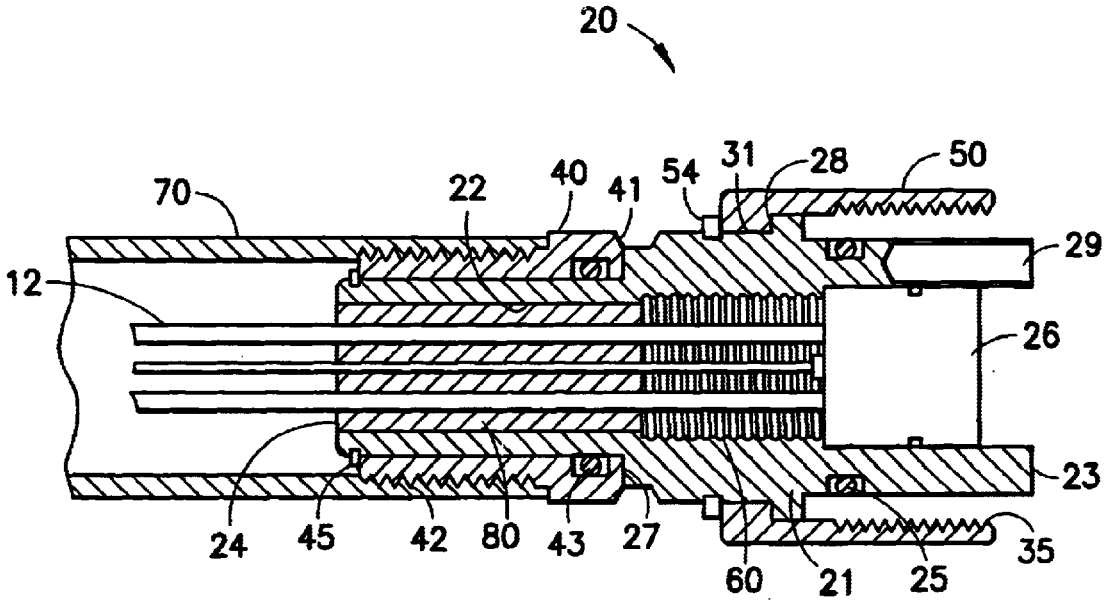
FIG. 3 is a cross-sectional view taken along line 2—2 of the female end illustrated in FIG. 2.

The female portion 20 of the explosion-proof instrument quick disconnect and seal 10 is best illustrated in FIGS. 2 and 3. The female portion 20 includes a generally cylindrical body 21 having a bore 22 therethrough extending along a longitudinal axis between a proximal end 23 and a distal end 24 of the body 21. The body is preferably made from stainless steel or other suitable materials to withstand potential explosive forces should gases or vapors ignite within the explosion-proof instrument quick disconnect and seal 10, as well as to resist oxidation or corrosion when exposed to the hazardous environment.

Preferably, the bore 22 is enlarged near the proximal end 23 of the body 21 for receiving a female electrical receptacle insert 26, which is preferably seated on a lip or flange 15 within the bore 22. The receptacle insert 26 may be secured within the bore in a conventional manner, such as through the use of flexible tabs projecting from the insert that are compressed by the wall of the bore 22 when the insert 26 is positioned within the body 21. Other conventional arrangements for securing the insert 26 within the body 21 are suitable for use with the present invention.

The receptacle insert 26 is preferably made of a non-electrically conductive material (e.g., plastic) and includes a plurality of female sleeves extending longitudinally therethrough. As will be discussed further below, the female sleeves, which are made from an electrically conductive material such as a gold plated copper alloy, have an opening on one end for receiving electrically conductive male pins 38 projecting from a male insert 36 retained in the male portion 30. Conventional electrical inserts 26, 36 may be used in accordance with the present invention, such as Circon R2.5 Series Circular Connectors.

As best illustrated in FIG. 3, the electrically conductive sleeves are electrically connected in a conventional manner (e.g., by crimping or soldering) to electrical conductors 12 (e.g., wires, cables, etc.) within the bore 22 of the body 21, which conductors 12 extend from the distal end 24 of the body 21 for connection to external circuits.

A union or swivel nut 40 is provided on the distal end 24 of the body 21 to facilitate connection of the explosion-proof instrument quick disconnect and seal 10 to an adjoining conduit system 70 (in FIG. 3) through which the conductors 12 may extend for connection to external circuits. The union 40 has a longitudinal bore extending therethrough such that the union 40 may be slid over and rotatably secured to the distal end 24 of the body 21. The union 40 is preferably slid over the distal end 24 of the body 21 until a proximal end 41 of the union engages a shoulder 27 formed on the exterior of the body 21. A retaining ring 45 may be positioned within a groove formed in the exterior of the body 21 near the distal end 24 to ensure that the union 40 does not separate from the body 21.

The exterior of the union 40 is preferably formed with external (male) threads 42 to facilitate connection to an adjoining conduit system (not shown) having internal (female) threads for engagement with the external (male) threads of the union 40. Other conventional arrangements for connecting the female portion 20 to an adjoining conduit system are also applicable with the present invention.

The union 40 is preferably made of stainless steel or other suitable materials to withstand potential explosive forces should gases or vapors ignite within the explosion-proof instrument quick disconnect and seal 10, as well as to resist oxidation or corrosion when exposed to the hazardous environment. An O-ring 43 or other suitable gasket is preferably positioned within a groove formed within the bore of union 40 to form a seal between the union 40 and the body 21, thereby preventing gases or vapors from the atmosphere (hostile environment) from passing between the union 40 and body 21 into the conduit system, and also helping to make the explosion-proof instrument quick disconnect and seal 10 watertight.

The female portion 20 of the explosion-proof instrument quick disconnect and seal 10 also includes a cylindrical coupling nut 50 having a bore extending longitudinally therethrough. The coupling nut 50 preferably includes an inwardly extending flange 51, which engages a shoulder 28 formed on the exterior of the body 21 when the body is received within the bore of the coupling nut 50. In this manner, the coupling nut 50 may be rotatably positioned about the circumference of the body 21. A retaining ring 54 may be positioned within a groove formed in the exterior of the body 21 to ensure that the coupling nut 50 does not separate from the body 21.

As will be discussed further below, the coupling nut 50 is provided with internal (female) threads 55 within its bore for threadingly engaging external (male) threads 37 formed about the exterior of the male portion 30. The coupling nut 50 is preferably made from stainless steel or other suitable materials to withstand potential explosive forces should gases or vapors ignite within the explosion-proof instrument quick disconnect and seal 10, as well as to resist oxidation or corrosion when exposed to the hazardous environment. Referring to FIG. 2, the exterior of the coupling nut is preferably knurled to facilitate gripping by a user to manually rotate the coupling nut 50 to either connect or disconnect the female and male portions 20, 30.

Figure 4:
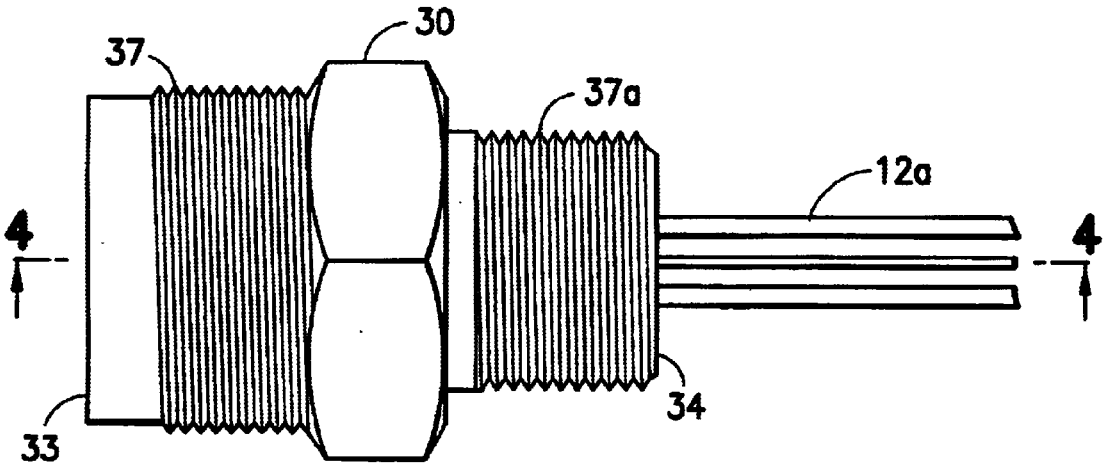
FIG. 4 is a side elevational view of the male end of the explosion-proof quick disconnect and seal illustrated in FIG. 1.
Figure 5:
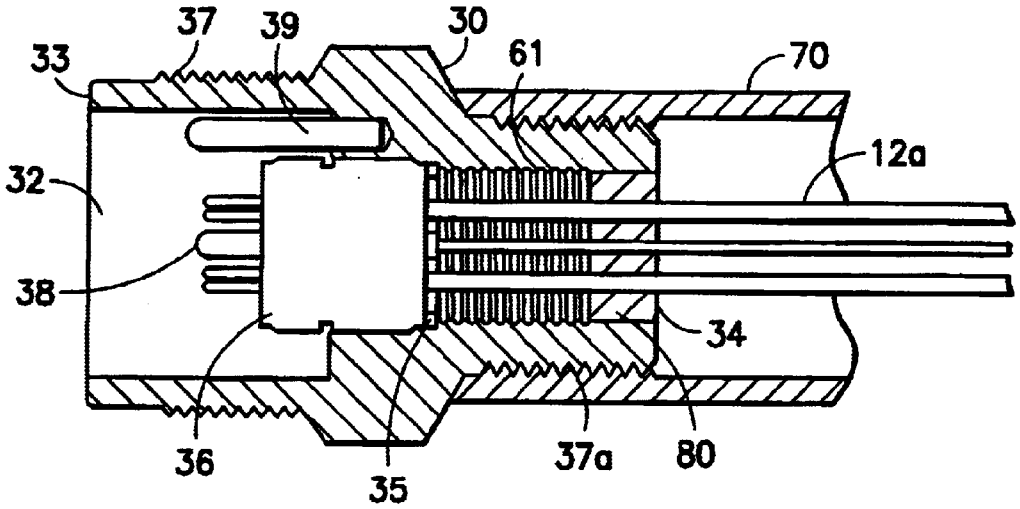
FIG. 5 is a cross-sectional view taken along line 4—4 of the male end illustrated in FIG. 4.

A male portion 30 of the explosion-proof instrument quick disconnect and seal 10, which mates with and connects to the female portion 20, is best illustrated in FIGS. 4 and 5. The male portion 30 is generally cylindrical in shape, having a bore 32 therethrough extending along a longitudinal axis between a proximal end 33 and a distal end 34 of the male portion 30. Like the female portion 20, the male portion 30 is preferably made from stainless steel or other suitable materials to withstand potential explosive forces should gases or vapors ignite within the explosion-proof instrument quick disconnect and seal 10, as well as to resist oxidation or corrosion when exposed to the hazardous environment.

Preferably, the bore 32 is enlarged near the proximal end 33 of the male portion 30 for receiving a male electrical receptacle insert 36, which is preferably seated on a lip or flange 35 within the bore 32. The male receptacle insert 36 is designed to mate with and electrically connect to the female receptacle insert 26 of the female portion 20 when the male and female portions 20, 30 are fully connected to one another. The male receptacle insert 36 may be secured within the bore 32 in a conventional manner, such as through the use of flexible tabs projecting from the insert that are compressed by the wall of the bore 32 when the insert 36 is positioned within the male portion 30. Other conventional arrangements may be used to secure the male receptacle insert 36 within the male portion 30.

The male receptacle insert 36 is preferably made of a non-electrically conductive material (e.g., plastic) and includes a plurality of electrically conductive pins or male contacts 38 that extend longitudinally through the insert 36 and project therefrom. The pins 38, which are made from an electrically conductive material, such as a gold plated copper alloy, are positioned such that each pin will engage and be electrically connected to a mating female sleeve in the female insert 26 when the male and female portions 20, 30 are properly aligned and fully connected to one another.

As best illustrated in FIG. 5, the electrically conductive pins 38 are electrically connected in a conventional manner (e.g., by crimping or soldering) to electrical conductors 12*a* (e.g., wires, cables, etc.) within the bore 32 of the male portion 30, which conductors 12*a* extend from the distal end 34 of the male portion 30 for connection to external circuits (e.g., a terminal strip within an enclosure for an electronic instrument). The male portion 30 is preferably connected to an electrical apparatus, conduit system or electrical enclosure, where the current path is in a direction from the female portion 20 to the male portion 30.

A conduit system 70 (in FIG. 5) is removably connected to the distal end 34 of the male portion 30 through which the conductors 12*a* may extend for connection to external circuits. Preferably, the distal end 34 of the male portion 30 is provided with external (male) threads 37*a* to facilitate connection to the adjoining conduit system (not shown) having internal (female) threads for engagement with the external (male) threads 37*a* of the male portion 30. Other conventional arrangements for connecting the male portion 30 to an adjoining conduit system are also applicable with the present invention.

The proximal end 33 of the male portion 30 is also provided with external (male) threads 37 for threadingly engaging the internal (female) threads 55 formed within the interior of the coupling nut 50. The inside diameter of the bore 32 about the proximal end 33 of the male portion 30 is sufficiently large to permit the proximal end 33 of the male portion 30 to be slid over the proximal end 23 of the female portion 20. However, the gap between the exterior wall of the proximal end 23 of the female portion 20 and the inside wall of the proximal end 33 of the male portion 30 should have very close tolerances (e.g., 0.002 inch) and should preferably meet the requirements of the NEC and testing agencies, such as Underwriters Laboratories ("UL") and Factory Mutual ("FM"). This gap is the path through which the hot gases or flames, produced by an internal explosion, may escape, and is known as the "flame path."

An O-ring 25 or other suitable gasket is preferably positioned within a groove formed within the exterior of the body 21 to form a seal between the male portion 30 and the body 21, thereby preventing gases or vapors from the atmosphere (hostile environment) from passing between the body 21 and the male portion 30 into the conduit system, and also helping to make the explosion-proof instrument quick disconnect and seal 10 watertight.

The outside diameter of the proximal end 33 of the male portion 30 is sized to permit the (male) threads 37 to threadingly engage the internal (female) threads 55 formed within the interior of the coupling nut 50 when the male and female portions 20, 30 are brought together. Thus, rotation of the coupling nut 50 will cause the internal (female) threads 55 to engage the external (male) threads 37 on the male portion 30 to thereby move the male portion 30 longitudinally relative to the female portion 20, while at the same time preventing the electrical connection of the receptacle insert 26 in the female portion 20 and male insert 36 in the male portion 30 before the explosion-proof chamber is secure.

As the coupling nut 50 is rotated (e.g., in a clockwise direction), the male and female portions 20, 30 of the quick disconnect and seal 10 advance toward one another by thread engagement. In the preferred embodiment, the male and female receptacle inserts 26, 36 are positioned within the male and female portions 20, 30 at a distance requiring approximately five threads of travel before electrical connections are made between the two mating receptacle inserts 26, 36. Thus, in the event of an internal explosion caused by arcing of the electrical contacts, five threads will be enough to prevent the male and female portions 20, 30 from separating and flying apart due to the pressure build up of the explosion. This number of threads will ensure that the minimal flame path length is also met.

Accordingly, in the preferred embodiment, when approximately five threads are engaged between the male portion 30 and coupling nut 50, the male insert 36 and female receptacle insert 26 have preferably traveled toward one another to the point where the two mating electrical inserts 26, 36 are about to make electrical contact. At this point, the "flame path" length is preferably no less than ¾ inch, and the male and female portions 20, 30 are firmly held together by the coupling nut 50. Additional rotation of the coupling nut 50 will fully engage the pins 38 of the male insert 36 within the sleeves of the female receptacle insert 26, thereby making good electrical contact.

The process works in reverse to disconnect the electrical circuit. That is, the coupling nut 50 may be rotated (e.g., in a counterclockwise direction) to separate the male and female portions 20, 30 and disconnect the circuit. In the preferred embodiment, when approximately five threads remain engaged between the coupling nut 50 and the male portion 30, the pins 38 in the male insert 36 are about to exit from the mating sleeves of the female receptacle insert 26, thereby breaking the electrical contact. At this point, the "flame path" is preferably no less than ¾ inch, and the male and female portions 20, 30 remain firmly held together by the coupling nut 50, preferably by no less than five threads. Further rotation of the coupling nut 50 and associated thread disengagement will completely separate the pins 38 in the male insert 36 from the mating sleeves in the female receptacle insert 26, and additional rotation of the coupling nut 50 will release the mechanical connection between the male and female portions 20, 30 so that they may be pulled apart and separated from one another.

As a safety precaution, it may be preferable that one of the pins 38 in the male receptacle insert 36 be longer than the remaining pins 38. This longer pin (not shown) will preferably serve as a ground pin to ensure that the quick disconnect and seal 10 is properly grounded before electrical connection of the remaining pins 38 in the male insert 26 with the mating sleeves in the female receptacle insert 26, as well as to ensure that the quick disconnect and seal 10 remains grounded up to the point of complete electrical disconnection of the remaining pins 38 in the male receptacle insert 36 from the mating sleeves in the female receptacle insert 26.

To facilitate proper alignment of the male and female portions 20, 30, an alignment pin or key 39, preferably made from stainless steel or some other suitably hard material, is preferably used in conjunction with a hole or key way 29 formed in the proximal end 23 of the female portion 20 to assure that the insertion of the female portion 20 within the male portion 30 is only possible when the pins 38 in the male insert 36 are properly aligned with the mating sleeves in the female receptacle insert 26. In the preferred embodiment, the hole 29 in the proximal end 23 of the female portion 20 acts as a keyway for the alignment key or pin 39 in the mating male portion 30 of the connector 10 to accurately align the male and female portions 20, 30 together. The alignment key or pin 39 and key way 29 ensure that the male and female portions 20, 30 of the connector 10 will mate properly. Because the pin 39 is preferably outside of the explosion proof chamber where the receptacle inserts 26, 36 engage, tolerances are not critical, thereby reducing manufacturing costs and making the connector 10 less prone to damage from rough handling during installation. This preferred arrangement is an improvement over the commonly used key system consisting of a channel or key way and a key, since a small burr or deformation in the key or key way will damage the device due to the close tolerances imposed by the explosion-proof services requirements.

In the preferred embodiment, the opening in the distal end 24 of the body 21 through which the electrical conductors 12 exit from the female portion 20 is completely sealed by preferably injecting a potting compound or sealing cement 80 (in FIG. 3) into the opening and within the bore 22 surrounding the electrical conductors 12. Indentations, grooves or threads 60 in this area within the bore 22 of the body 21 are preferably provided to permit the potting compound or sealing cement to fill the indentations, grooves or threads 60, thereby increasing the holding strength of the potting compound or sealing cement.

Similarly, in the preferred embodiment, the opening in the distal end 34 of the male portion 30 through which the electrical conductors 12*a* exit is completely sealed by preferably injecting a potting compound or sealing cement 80 (FIG. 5) into the opening and within the bore 32 surrounding the electrical conductors 12*a*. Indentations, grooves or threads 61 in this area within the bore 32 are preferably provided to permit the potting compound or sealing cement to fill the indentations, grooves or threads 61, thereby increasing the holding strength of the potting compound or sealing cement.

Although an illustrative preferred embodiment has been described herein in detail, it should be noted and will be appreciated by those skilled in the art that numerous variations may be made within the scope of this invention without departing from the principle of this invention and without sacrificing its chief advantages. The terms and expressions have been used herein as terms of description and not terms of limitation. There is no intention to use the terms or expressions to exclude any equivalents of features shown and described or portions thereof and this invention should be defined in accordance with the claims that follow.

I claim:

1. An explosion-proof instrument quick disconnect and seal for use in hazardous environments, comprising:

a first portion having a first bore extending therethrough from a proximal end to a distal end;

a second portion detachably coupled to the first portion and having a second bore extending therethrough from a first end to a second end, the second end of the second portion being received within the first bore of the first portion to define an explosion-proof chamber within the first and second portions when the first and second portions are coupled to one another;

a first electrical insert having electrical contacts positioned within the first bore of the first portion; and a second electrical insert having electrical contacts positioned within the second bore of the second portion;

a coupling having a third bore therethrough, the coupling rotatably positioned on the second portion and having threads formed within the third bore for engaging mating threads formed on the first portion to detachably couple the first portion to the second portion;

wherein each of the electrical contacts in the first electrical insert engage and form an electrical connection with a respective electrical contact in the second electrical insert within the explosion-proof chamber when the first and second portions are coupled to one another;

wherein rotation of the coupling in a first direction causes the first portion to move longitudinally toward the second portion to electrically connect the respective contacts of the first and second electrical inserts after a predetermined number of threads on the first portion and coupling engage, and wherein rotation of the coupling in the opposite direction causes the first portion to move longitudinally away from the second portion to electrically disconnect the respective contacts of the first and second electrical inserts.

2. The explosion-proof instrument quick disconnect and seal according to claim 1, wherein the predetermined number of threads is at least approximately five threads.

3. The explosion-proof instrument quick disconnect and seal according to claim 1, wherein the coupling is made from stainless steel.

4. The explosion-proof instrument quick disconnect and seal according to claim 1, wherein the electrical inserts are made of non-electrically conductive material.

5. The explosion-proof instrument quick disconnect and seal according to claim 1, wherein the contacts in the first insert are electrically conductive pins and the contacts in the second insert are electrically conductive sleeves for receiving a respective electrically conductive pin.

6. The explosion-proof instrument quick disconnect and seal according to claim 5, wherein one of the contacts in the first insert is a ground pin that is longer than the remaining pins to ensure that the quick disconnect and seal is grounded before the remaining pins are electrically connected to the respective sleeves in the second insert and remains grounded until after the remaining pins are electrically disconnected from the respective sleeves in the second insert.

7. The explosion-proof instrument quick disconnect and seal according to claim 1, wherein each of the contacts in the first and second inserts is electrically connected to a respective electrical conductor.

8. The explosion-proof instrument quick disconnect and seal according to claim 7, wherein the electrical conductor is soldered to a respective contact in the first or second inserts.

9. The explosion-proof instrument quick disconnect and seal according to claim 7, wherein the electrical conductor is crimped to a respective contact in the first or second inserts.

10. The explosion-proof instrument quick disconnect and seal according to claim 7, wherein the electrical conductors connected to the contacts of the first insert extend out of the first bore and through the distal end of the first portion, the quick disconnect and seal further comprising a seal within the first bore to prevent gases or vapors from passing between the explosion-proof chamber and out the distal end of the first portion.

11. The explosion-proof instrument quick disconnect and seal according to claim 10, wherein the seal is made from a sealing compound.

12. The explosion-proof instrument quick disconnect and seal according to claim 7, wherein the electrical conductors connected to the contacts of the second insert extend out of the second bore and through the second end of the second portion, the quick disconnect and seal further comprising a seal within the second bore to prevent gases or vapors from passing between the explosion-proof chamber and out the first end of the second portion.

13. The explosion-proof instrument quick disconnect and seal according to claim 12, wherein the seal is made from a sealing compound.

14. The explosion-proof instrument quick disconnect and seal according to claim 1, wherein the first and second portions are made from stainless steel.

15. The explosion-proof instrument quick disconnect and seal according to claim 1, wherein each end of the quick disconnect and seal is connected to an adjoining conduit.

16. The explosion-proof instrument quick disconnect and seal according to claim 1, wherein a plurality of threads are formed on the distal end of the first portion for detachably engaging mating threads formed in an adjoining conduit.

17. The explosion-proof instrument quick disconnect and seal according to claim 1, further comprising a union rotatably positioned on an end of the quick disconnect and seal for connecting the quick disconnect and seal to an adjoining conduit.

18. The explosion-proof instrument quick disconnect and seal according to claim 17, wherein the union is rotatably positioned on the first end of the second portion.

19. The explosion-proof instrument quick disconnect and seal according to claim 17, wherein the union comprises a plurality of threads for detachably engaging mating threads formed in the conduit.

20. The explosion-proof instrument quick disconnect and seal according to claim 17, wherein the union is made from stainless steel.

21. The explosion-proof instrument quick disconnect and seal according to claim 1, further comprising a locating pin extending from the proximal end of the first portion, the locating pin being received within a hole formed in the second end of the second portion to facilitate proper alignment of the respective contacts in the first and second inserts.

22. The explosion-proof instrument quick disconnect and seal according to claim 1, further comprising a seal positioned between the first and second portions to prevent gases or vapors from entering the quick disconnect and seal.

23. The explosion-proof instrument quick disconnect and seal according to claim 22, wherein the seal is an O-ring positioned within a groove formed in the exterior of the second portion.

24. The explosion-proof instrument quick disconnect and seal according to claim 1, wherein the first and second portions may be coupled to one another without interrupting the power supply to the contacts of the first or second inserts.

25. The explosion-proof instrument quick disconnect and seal according to claim 1, wherein the first and second portions may be detached from one another without first interrupting the power supply to the contacts of the first or second inserts.

* * * * *